US007921764B2

(12) United States Patent
Takeshita

(10) Patent No.: US 7,921,764 B2
(45) Date of Patent: Apr. 12, 2011

(54) HYDRAULIC CONTROL DEVICE OF WORKING MACHINE

(75) Inventor: Tatsuya Takeshita, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 554 days.

(21) Appl. No.: 12/098,128

(22) Filed: Apr. 4, 2008

(65) Prior Publication Data

US 2008/0250782 A1 Oct. 16, 2008

(30) Foreign Application Priority Data

Apr. 10, 2007 (JP) ..... 2007-102937

(51) Int. Cl.
*F15B 11/042* (2006.01)

(52) U.S. Cl. ..... 91/513

(58) Field of Classification Search ..... 91/513; 60/422

See application file for complete search history.

(56) References Cited

U.S. PATENT DOCUMENTS

| | | | | |
|---|---|---|---|---|
| 5,493,950 | A * | 2/1996 | Kim | 91/516 |
| 5,813,311 | A * | 9/1998 | Toyooka et al. | 91/513 |
| 6,430,922 | B2 | 8/2002 | Tohji | |
| 7,356,991 | B2 * | 4/2008 | Kim et al. | 60/422 |

FOREIGN PATENT DOCUMENTS

| | | |
|---|---|---|
| EP | 1 674 735 A2 | 6/2006 |
| GB | 2 271 869 A | 4/1994 |
| JP | 60-5928 | 1/1985 |
| JP | 2001-295804 | 10/2001 |

* cited by examiner

*Primary Examiner* — F. Daniel Lopez
(74) *Attorney, Agent, or Firm* — Oblon, Spivak, McClelland, Maier & Neustadt, L.L.P.

(57) ABSTRACT

A rotation prioritizing valve serving as a flow rate control valve of a hydraulic pilot type is provided on the meter-in side of an arm cylinder. At the time of a combined operation of arm pulling and rotation, the rotation prioritizing valve is activated by rotation pilot pressure so that a meter-in flow rate of the arm cylinder is throttled to prioritize rotation movement. On the premise of the above, a switching valve is provided in a pilot line of the rotation prioritizing valve and switched so as to release a throttling effect of the rotation prioritizing valve when boom lowering movement is added to the combined operation of arm pulling and rotation so that a rotation prioritizing function is cancelled.

10 Claims, 4 Drawing Sheets

HYDRAULIC CONTROL DEVICE OF WORKING MACHINE

BACKGROUND OF THE INVENTION

1. Field of the Invention

The present invention relates to a hydraulic control device provided with a rotation prioritizing function in a working machine such as a hydraulic excavator.

2. Description of the Related Art

In a hydraulic excavator, as shown in FIG. 3, a boom 3, an arm 4, a bucket 5 and a working (excavating) attachment 9 including a boom cylinder 6, an arm cylinder 7 and a bucket cylinder 8 for driving the boom, the arm and the bucket are mounted to an upper rotating body 2 rotatably around a vertical shaft O mounted on a crawler type lower traveling body 1.

As other hydraulic actuators, left and right traveling motors (not shown) for driving the lower traveling body 1, and a rotation motor 10 for driving and rotating the upper rotating body 2 are provided.

In such a case, for example, a combined operation of arm pulling and rotation for rotating while pulling the arm 4 (extending the arm cylinder 7) after earth and sand are loaded onto a delivery vehicle so as to return to an excavating point is frequently performed.

In such a case, since the arm 4 moves in the free-fall direction, a working pressure of the arm cylinder 7 is lower than working pressure of the rotation motor 10. Therefore, most of pump discharge oil is sent to the arm cylinder 7 so that a flow rate is insufficient in the rotation motor 10. Consequently, rotation speed is remarkably decreased and working efficiency and operability are deteriorated.

There is a technique taking a rotation prioritizing measure in which a rotation prioritizing valve serving as a flow rate control valve is provided on one of the meter-in side and the meter-out side or on both the sides (a description will be given to the case of the meter-in) of a control valve for controlling an action of the arm cylinder 7, and at the time of the combined operation, the working pressure is raised by throttling a meter-in flow rate of the arm cylinder 7 by the rotation prioritizing valve so as to ensure a flow rate supplied to the rotation motor (rotation movement) (refer to Japanese Patent Laid-Open No. 2001-295804).

A description will be given to a circuit configuration thereof with reference to FIG. 4.

It should be noted that in a general hydraulic excavator, all the hydraulic actuators are divided into two groups and the actuators of both the groups are driven by separate hydraulic pumps (first and second hydraulic pumps), while discharge oil of both the pumps are joined together at the time of the combined operation or the like. However, in order to facilitate the description, the circuit configuration in which all the actuators are driven by one hydraulic pump will be described.

For similar reasons, FIG. 4 only shows the boom cylinder 6, the arm cylinder 7 and the rotation motor 10 as the hydraulic actuators.

The discharge oil from a hydraulic pump 11 serving as a common pressure oil supply source for the actuator groups is supplied to the rotation motor 10, the boom cylinder 6 and the arm cylinder 7 through a rotation control valve 12, a boom control valve 13 and an arm control valve 14 (hydraulic pilot switching valves) separately operated by remote controller valves (not shown). T denotes a tank.

On the meter-in side of the arm control valve 14, a rotation prioritizing valve 15 serving as a flow rate control valve of a hydraulic pilot type is provided.

A pilot port 15*a* of the rotation prioritizing valve 15 is connected to pilot lines 18 and 19 on the both sides of the rotation control valve 12 through a rotation prioritizing pilot line 16 and a shuttle valve 17. At the time of movement of the control valve 12, that is, at the time of rotation movement, the rotation prioritizing valve 15 is switched from an entirely opening position x shown in the figure to a throttling position y.

Thereby, at the time of the combined operation of arm pulling and rotation, the meter-in flow rate of the arm cylinder 7 is throttled and the working pressure of the cylinder 7 is increased so as to ensure an action of the rotation motor 10. That is, a rotation prioritizing function is activated.

In such a state, the flow rate of the arm cylinder is decreased in comparison with the case where the rotation prioritizing function is not activated. However, since a required flow rate is small, especially, in the arm pulling movement, there is no problem in movement of the arm 4.

However, in the circuit shown in the figure, the arm pulling is not distinguished from the arm pushing with the working pressure which is higher than the arm pulling. Therefore, since the rotation prioritizing function is also activated at the time of the combined operation of arm pushing and rotation, the arm pushing movement is slightly deteriorated.

However, in the circuit configuration provided with the rotation prioritizing function, as an adverse effect, when other actuator movement (such as boom lowering movement and bucket movement) is added at the time of the combined operation, that is, in a state that the working pressure of the arm cylinder 7 is increased, the working pressure of the added actuator is relatively low so that the oil is further required and hence the flow rate of the arm cylinder is insufficient. Thereby, since the arm pulling movement is stopped or extremely deteriorated to a state close to the stoppage, movement of the entire attachment is deteriorated so as to cause a problem that the working efficiency is extremely lowered.

SUMMARY OF THE INVENTION

It is an object of the present invention to provide a hydraulic control device of working machine capable of supplementing arm pulling movement in the case where other actuator movement is added at a combined operation of arm pulling and rotation.

The present invention is a hydraulic control device of working machine comprising hydraulic actuators including a rotation motor for rotation movement of an upper rotating body and an arm cylinder for arm pushing and pulling movement, a hydraulic pump serving as a hydraulic source, control valves for separately controlling an action of the hydraulic actuators and a rotation prioritizing valve, the device performing a rotation prioritizing function for prioritizing the rotation movement by an effect of the rotation prioritizing valve at the time of a combined operation of arm pulling and rotation in which the rotation movement and the arm pulling movement are performed at the same time, and the device further comprising rotation priority restricting means adapted to restrict the rotation prioritizing function at the time of a specific combined operation in which movement of other hydraulic actuator is added to the combined operation of arm pulling and rotation.

According to the present invention, on the premise that the rotation movement is prioritized by the effect of the rotation prioritizing valve (such as a throttling effect of a flow rate control valve) at the time of the combined operation of arm pulling and rotation, the rotation prioritizing function is restricted (cancelled or lowered) at the time of the specific combined operation in which the movement of other actuator is added to the combined operation of arm pulling and rotation. Therefore, the flow rate of the arm cylinder is no more insufficient so as to ensure the arm pulling movement.

When the arm pulling is not distinguished from the arm pushing as mentioned above, a circuit for distinction is not required so as to simplify the circuit configuration. On the other hand, since the rotation prioritizing function is activated even at the time of a combined operation of arm pushing and rotation (including the case where the arm pulling is changed into the arm pushing during the combined operation of arm pulling and rotation), there is sometimes a case where the arm pushing movement is deteriorated.

In regard to this point, in the above configuration, the rotation priority restricting means is preferably adapted to restrict the rotation prioritizing function at the time of the combined operation of arm pushing and rotation in which the rotation movement and the arm pushing movement are performed at the same time.

In such a case, since the rotation prioritizing function is restricted at the time of the combined operation of arm pushing and rotation, it is possible to ensure favorable arm pushing movement.

DESCRIPTION OF THE PREFERRED EMBODIMENTS

A description will be given to embodiments of the present invention with reference to FIGS. 1 and 2.

In the embodiments below, in order to facilitate the description, a circuit configuration in which all the actuators are driven by one hydraulic pump is adopted in correspondence with DESCRIPTION OF THE RELATED ART mentioned above. As hydraulic actuators, only a boom cylinder 6, an arm cylinder 7 and a rotation motor 10 will be shown.

Figure 1:
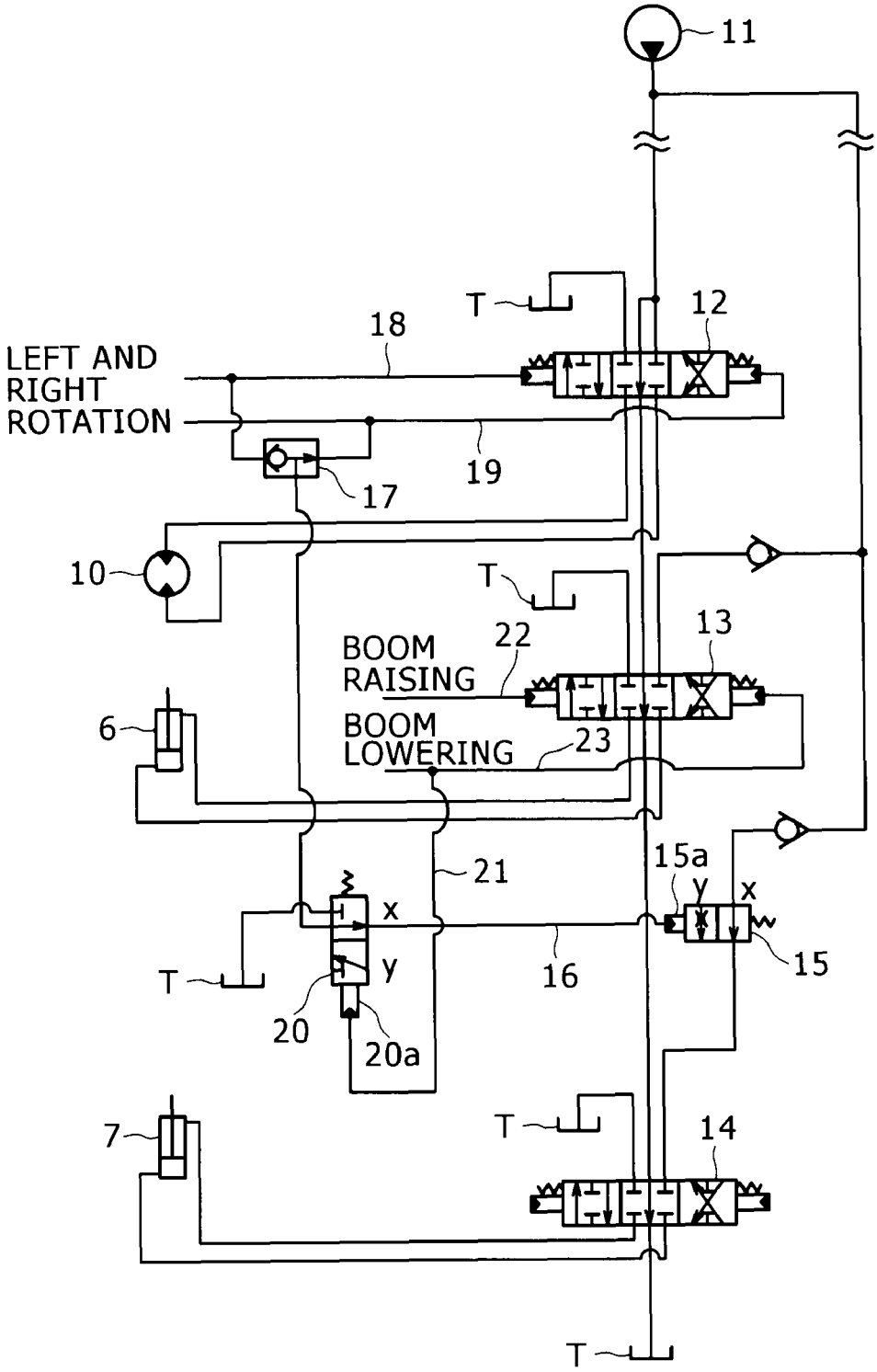
FIG. 1 is a circuit configuration diagram showing a first embodiment of the present invention.
Figure 4:
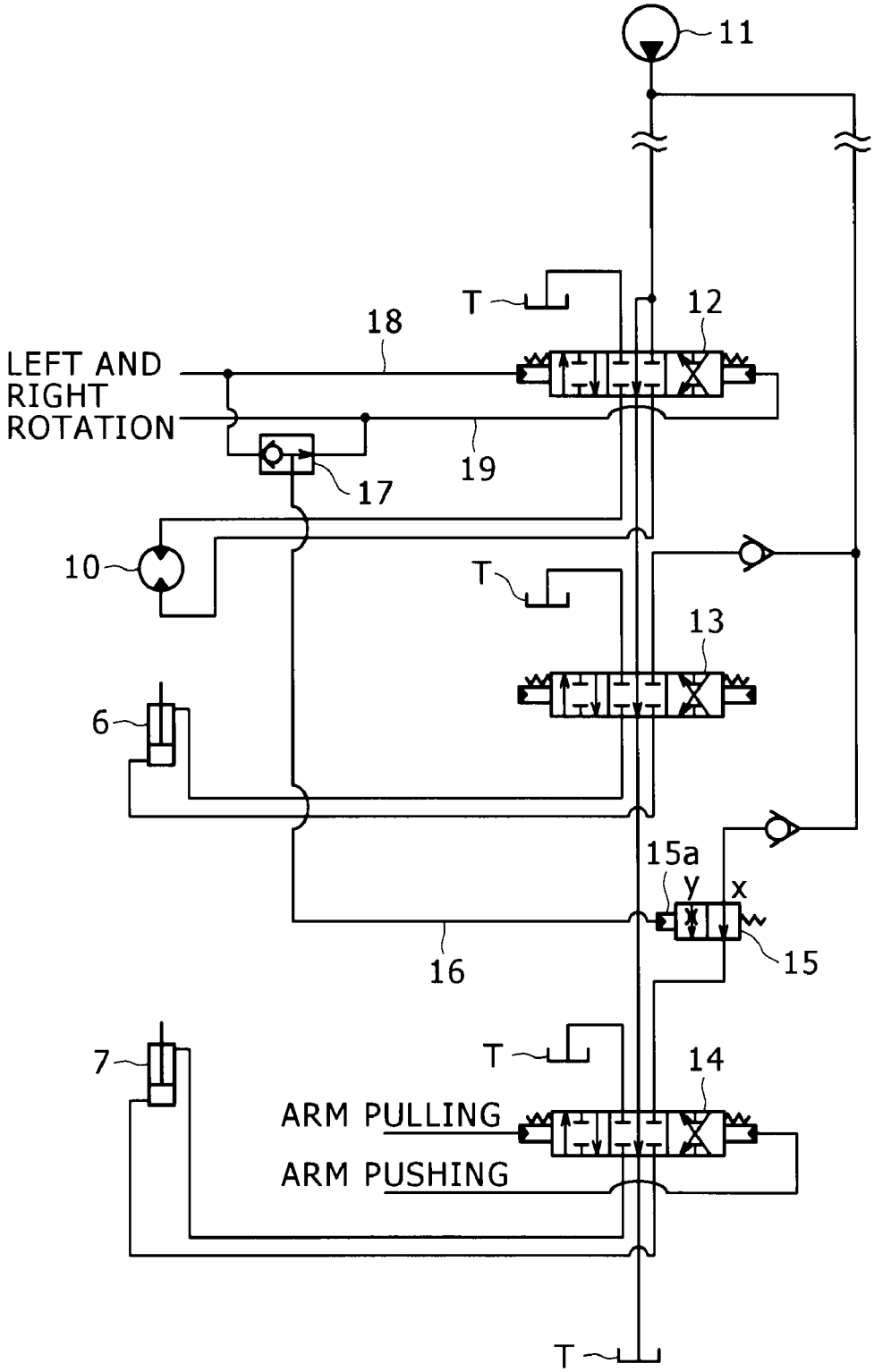
FIG. 4 is a conventional circuit configuration diagram.

In FIG. 1, the same parts as THE RELATED ART shown in FIG. 4 are given the same reference numerals and repeated explanation will be omitted.

First Embodiment

Refer to FIG. 1

A basic configuration below is the same as THE RELATED ART of FIG. 4:

(i) A rotation prioritizing valve 15 serving as a flow rate control valve of a hydraulic pilot type is provided on the meter-in side of an arm control valve 14;

(ii) A pilot port 15*a* of the rotation prioritizing valve 15 is connected to pilot lines 18 and 19 on the both sides of a rotation control valve 12 through a rotation prioritizing pilot line 16 and a shuttle valve 17; and (iii) At the time of operating the control valve 12 (at the time of rotation movement), since the rotation prioritizing valve 15 is switched from an entirely opening position x shown in the figure to a throttling position y, a meter-in flow rate of the arm cylinder 7 is throttled and working pressure of the cylinder 7 is increased at the time of a combined operation of arm pulling and rotation so as to ensure an action of the rotation motor 10. (A rotation prioritizing function is activated.)

In such a device, a hydraulic pilot type switching valve 20 is provided in the rotation prioritizing pilot line 16 connecting the pilot port 15*a* of the rotation prioritizing valve 15 and the shuttle valve 17.

The switching valve 20 has a rotation prioritizing position x for opening the rotation prioritizing pilot line 16 and leading rotation pilot pressure to the pilot port 15*a* of the rotation prioritizing valve 15 and a rotation priority restricting position y for communicating the rotation prioritizing pilot line 16 with a tank T. When the pilot pressure is not introduced to the pilot port 20*a*, the switching valve 20 is set to the rotation prioritizing position x shown in the figure.

In such a state, at the time of the operation of arm pulling and rotation, the rotation pilot pressure is supplied to the pilot port 15*a* of the rotation prioritizing valve 15 and the rotation prioritizing valve 15 is switched from the entirely opening position x to the throttling position y so that a throttling effect (rotation prioritizing function) is activated.

A pilot line 21 connected to a pilot port 20*a* of the switching valve 20 is connected to a boom lowering side pilot line 23 among a boom raising side pilot line 22 and the boom lowering side pilot line 23 of a boom control valve 13. Therefore, when a boom lowering operation is performed, the switching valve 20 is switched from the rotation prioritizing position x to the rotation priority restricting position y.

Consequently, when the boom lowering operation is added during the combined operation of arm pulling and rotation, the switching valve 20 is switched to the rotation priority restricting position y so that the rotation prioritizing valve 15 is returned to the entirely opening position x. Therefore, the rotation prioritizing function is cancelled.

Thereby, a required flow rate of the arm cylinder 7 is ensured and both the arm pulling movement and the boom lowering movement at the time of a specific combined operation are smoothly performed.

Figure 3:
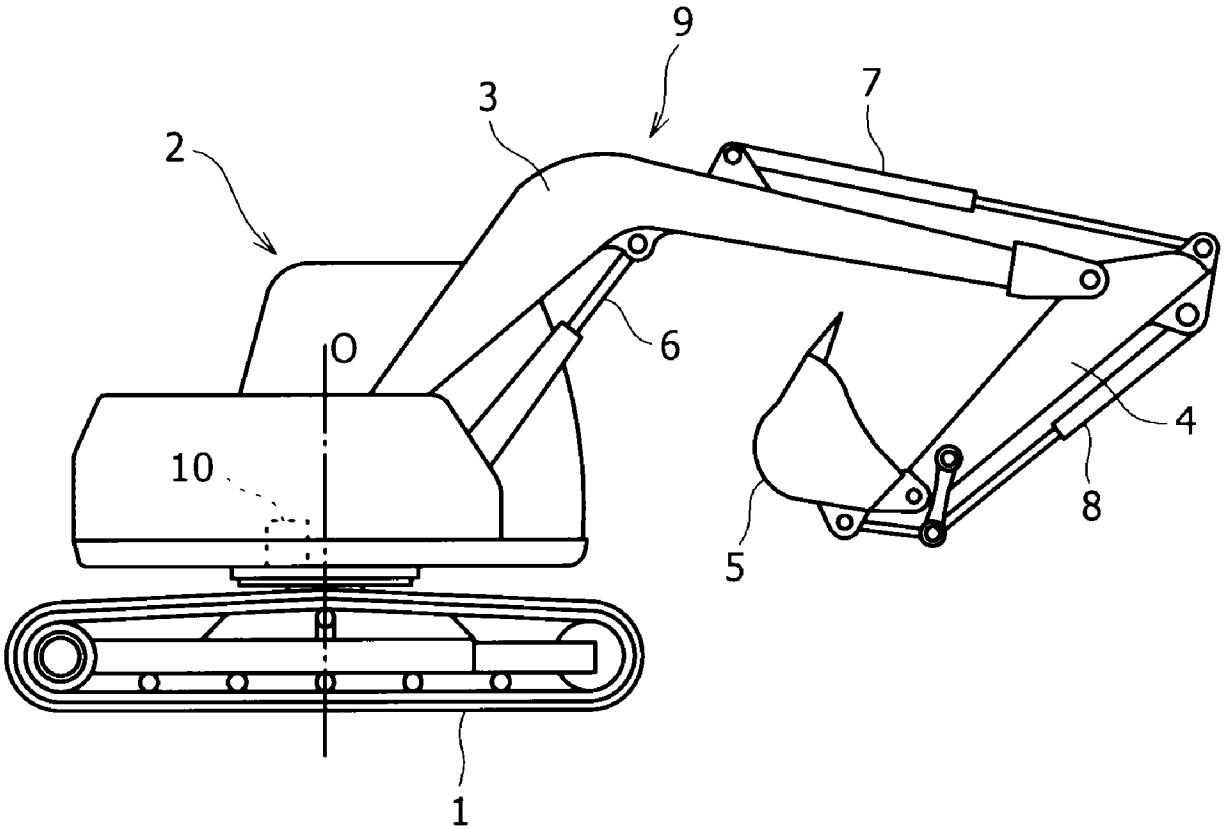
FIG. 3 is a schematic side view of a hydraulic excavator.

It should be noted that a supply flow rate of the rotation motor 10 with high working pressure is decreased and hence the rotation movement is slowed down. However, the slow rotation movement is more desirable for the movement of the entire attachment 9 than stoppage of the movement of the arm 4 in FIG. 3 or a state close to the stoppage thereof.

According to the circuit configuration of the present embodiment, on the premise that the pilot pressure of the rotation prioritizing valve 15 of a hydraulic pilot type is controlled by the switching valve 20 so that the rotation prioritizing function is activated or restricted, the rotation prioritizing valve 15 is activated by utilizing the pilot pressure of the rotation control valve 12. Therefore, there is neither need for providing a pilot pressure source exclusively for the rotation prioritizing valve nor need for adding extra control means. Moreover, the rotation prioritizing movement and the restricting movement thereof are surely performed and worked together with the rotation operation.

Further, the switching valve 20 is controlled by the pilot pressure of the boom lowering serving as an additional operation. Therefore, there is no need for control means for detecting the pilot pressure source for the switching valve and the additional operation and supplying the pilot pressure to the switching valve 20. A function for restricting the rotation priority is surely performed at the time of the specific combined operation.

Second Embodiment

Figure 2:
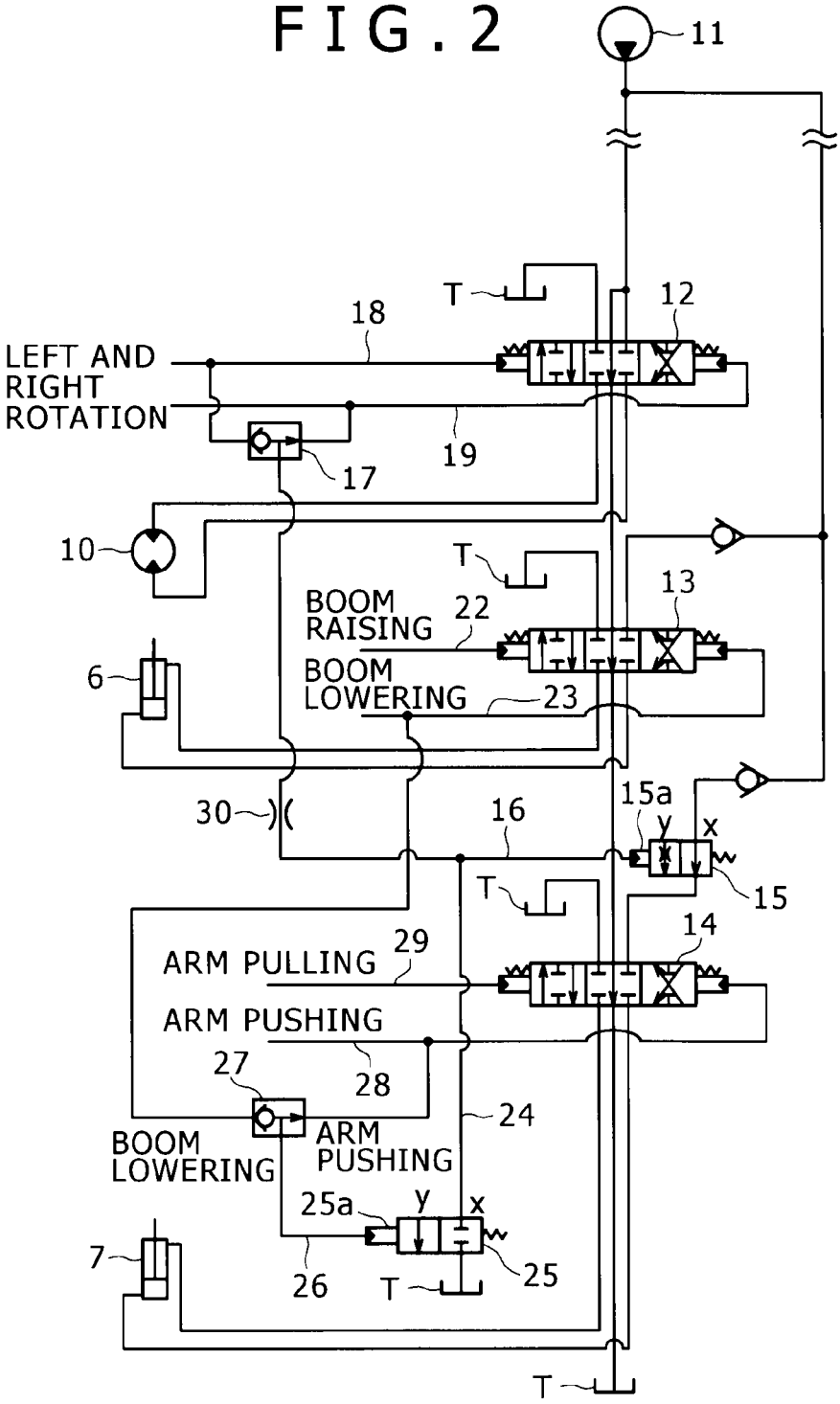
FIG. 2 is a circuit configuration diagram showing a second embodiment of the present invention.

Refer to FIG. 2

A description will be only given to a different point from the first embodiment.

According to the circuit configuration of the first embodiment, since the arm pulling is not distinguished from the arm pushing as mentioned above, the circuit for distinction is not required so as to simplify the circuit configuration. On the other hand, the rotation prioritizing function is also activated at the time of the combined operation of arm pushing and rotation (including the case where the arm pulling is changed into the arm pushing during the combined operation of arm pulling and rotation). Therefore, the arm pushing movement with the working pressure which is higher than the arm pulling is deteriorated.

In a second embodiment, a countermeasure against the above point is considered.

That is, a tank line 24 for communicating the rotation prioritizing pilot line 16 with a tank T is branched from and connected to the rotation prioritizing pilot line 16 connecting the pilot port 15*a* of the rotation prioritizing valve 15 and the shuttle valve 17, and a switching valve 25 of a hydraulic pilot type is provided in the tank line 24.

The switching valve 25 has a rotation prioritizing position x for blocking the rotation prioritizing pilot line 16 from the tank T and a rotation priority restricting position y for communicating the rotation prioritizing pilot line 16 with the tank T. When the pilot pressure is introduced to a pilot port 25*a*, the switching valve 25 is switched from the rotation prioritizing position x shown in the figure to the rotation priority restricting position y.

The pilot port 25*a* of the switching valve 25 is connected to the boom lowering side pilot line 23 and an arm pushing side pilot line 28 (the reference numeral 29 denotes an arm pulling side pilot line) through a pilot line 26 and a shuttle valve 27.

According to the above configuration, the rotation is prioritized at the time of the combined operation of arm pulling and rotation, and the rotation priority is released at the time of a specific combined operation of arm pulling, boom lowering and rotation. Meanwhile, at the time of the combined operation of arm pushing and rotation (including the case where the arm pulling is changed into the arm pushing during the combined operation of arm pulling and rotation), the pilot pressure on the arm pushing side is added to the switching valve 25 so that the switching valve 25 is switched to the rotation priority restricting position y. Therefore, the rotation pilot pressure is brought down to the tank T so that the rotation prioritizing valve 15 is set to the entirely opening position x. That is, as in the time of the specific combined operation of arm pulling, boom lowering and rotation, the rotation prioritizing function is cancelled. Thereby, favorable arm pushing movement is ensured.

In such a state, since the pilot lines 18 and 19 of the rotation control valve 12 are communicated with the tank T, a throttle 30 is provided on the upstream side of a point branched to the tank line 24 in the rotation prioritizing pilot line 16 in order to ensure the pilot pressure of the valve 12.

It should be noted that the prioritizing pilot line 16 is communicated with the tank T and the switching valve 25 is switched to the rotation priority restricting position y by at least one movement among the arm pushing and the boom lowering. Therefore, it goes without saying that the rotation prioritizing function is also cancelled at the time of the combined operation of arm pushing, boom lowering and rotation.

Other Embodiments (1) In the first and second embodiments, the meter-in flow rate of the arm cylinder 7 is throttled by the rotation prioritizing valve 15. However, a meter-out flow rate or both the flow rates may be throttled.

(2) In both the embodiments, the rotation prioritizing function is "cancelled" by switching the rotation prioritizing valve 15 from the throttling position y to the entirely opening position x at the time of specific combined operation. However, the rotation prioritizing function may be "lowered" by decreasing the pilot pressure supplied to the rotation prioritizing valve 15.

(3) In both the embodiments, the rotation prioritizing valve 15 is switched to the throttling position y by the rotation pilot pressure at the time of the combined operation of arm pulling and rotation. However, the rotation operation may be detected by a sensor and hence the rotation prioritizing valve 15 may be switched to the throttling position y by pilot pressure from other pilot pressure source due to an action of a solenoid valve based on a signal from a controller.

(4) Similarly, at the time of the specific combined operation, as means for switching the switching valves 20 and 25 to the rotation priority restricting position y, the boom lowering operation may be detected by a sensor and hence the switching valves 20 and 25 may be switched to the rotation priority restricting position y by pilot pressure from other pilot pressure source due to an action of a solenoid valve based on a signal from a controller.

(5) In both the embodiments, the rotation prioritizing function is restricted when the boom lowering operation is added to the combined operation of arm pulling and rotation as the time of the specific combined operation. However, the rotation prioritizing function may be restricted when one of the boom lowering operation and the bucket operation or both the operations is/are added as the time of the specific combined operation.

(6) The present invention is not limited to a hydraulic excavator, but can be applied to other working machines such as a crusher and a demolition machine using the hydraulic excavator as a base.

Although the invention has been described with reference to the preferred embodiments in the attached figures, it is noted that equivalents may be employed and substitutions made herein without departing from the scope of the invention as recited in the claims.

I claim:

1. A hydraulic control device of working machine, comprising:

hydraulic actuators including a rotation motor for rotation movement of an upper rotating body and an arm cylinder for arm pushing and pulling movement;

a hydraulic pump serving as a hydraulic source;

control valves for separately controlling an action of each of said hydraulic actuators;

a rotation prioritizing valve, a rotation prioritizing function for prioritizing the rotation movement being executed by an effect of the rotation prioritizing valve at the time of a combined operation of arm pulling and rotation in which the rotation movement and the arm pulling movement are performed at the same time; and rotation priority restricting means adapted to restrict the rotation prioritizing function at the time of a specific combined operation in which movement of other hydraulic actuator is further added to the combined operation of arm pulling and rotation.

2. The hydraulic control device of working machine according to claim 1, wherein said rotation priority restricting means is adapted to restrict the rotation prioritizing function at the time of a combined operation of arm pushing and rotation in which the rotation movement and arm pushing movement are performed at the same time.

3. The hydraulic control device of working machine according to claim 1, wherein said rotation prioritizing valve is formed as a flow rate control valve for throttling at least one of a meter-in flow rate and a meter-out flow rate of the arm cylinder, and said rotation priority restricting means is adapted to release or lower a throttling effect of said rotation prioritizing valve at the time of the specific combined operation.

4. The hydraulic control device of working machine according to claim 3, wherein said rotation prioritizing valve is formed as a flow rate control valve of a hydraulic pilot type with an opening degree changed in accordance with an inputted pilot pressure, and said rotation priority restricting means is adapted to control the pilot pressure of said rotation prioritizing valve.

5. The hydraulic control device of working machine according to claim 4, wherein as said rotation priority restricting means, a switching valve switched by an operation signal from the outside is provided in a pilot line of said rotation prioritizing valve, the switching valve being switched between a rotation prioritizing position in which the pilot line of the said rotation prioritizing valve is connected to a pilot pressure source and a rotation priority restricting position in which the pilot line is connected to a tank.

6. The hydraulic control device of working machine according to claim 5, wherein a hydraulic pilot valve is used as said rotation control valve, and pilot pressure of said rotation control valve is supplied to a pilot port of said rotation prioritizing valve in a state that said switching valve is switched to the rotation prioritizing position.

7. The hydraulic control device of working machine according to claim 5, wherein hydraulic pilot valves are used as said control valve for said hydraulic actuator which is additionally operated and the switching valve respectively, and a pilot line of the switching valve is connected to a pilot line of said control valve for said hydraulic actuator which is additionally operated.

8. The hydraulic control device of working machine according to claim 4, wherein as said rotation priority restricting means, a tank line for communicating a pilot line with a tank is branched from and connected to the pilot line of said rotation prioritizing valve, and a switching valve switched by an operation signal from the outside is provided in the tank line, the switching valve being switched between a rotation prioritizing position in which the pilot line of the said rotation prioritizing valve is blocked from the tank and a rotation priority restricting position in which the pilot line is communicated with the tank.

9. The hydraulic control device of working machine according to claim 8, wherein a hydraulic pilot valve is used as said rotation control valve, and pilot pressure of said rotation control valve is supplied to a pilot port of said rotation prioritizing valve in a state that said switching valve is switched to the rotation prioritizing position.

10. The hydraulic control device of working machine according to claim 8, wherein hydraulic pilot valves are used as said control valve for said hydraulic actuator which is additionally operated and the switching valve respectively, and a pilot line of the switching valve is connected to a pilot line of said control valve for said hydraulic actuator which is additionally operated.

* * * * *